US006185754B1

(12) United States Patent
Dysle

(10) Patent No.: US 6,185,754 B1
(45) Date of Patent: Feb. 13, 2001

(54) AUTOMATIC TOILET SEAT

(76) Inventor: Howard Dysle, 825 Balboa Ave. #203, Capitola, CA (US) 95010

( * ) Notice: Under 35 U.S.C. 154(b), the term of this patent shall be extended for 0 days.

(21) Appl. No.: 09/292,583

(22) Filed: Apr. 15, 1999

(51) Int. Cl.[7] ..... A47K 13/10
(52) U.S. Cl. ..... 4/246.2
(58) Field of Search ..... 4/246.2

(56) References Cited

U.S. PATENT DOCUMENTS 2,214,323 * 9/1940 Carter ..... 4/246.2

* cited by examiner

*Primary Examiner*—Robert M. Fetsuga

(57) ABSTRACT

A toilet seat automatic lowering system is provided including a toilet having a bowl portion with an open top having an upper peripheral edge, an annular seat with a generally planar O-shaped configuration, a rear tank portion extending upwardly from a rear of the bowl portion, and a water intake line. In use, the toilet is adapted to accept water from the water intake line upon being flushed. Also included is at least one mounting assembly coupled to the bowl portion and pivotally coupled with respect to the seat of the toilet. The mounting assembly is in communication with either the rear tank portion or the water line of the toilet for effecting the lowering of the seat of the toilet upon the same being flushed.

2 Claims, 3 Drawing Sheets

AUTOMATIC TOILET SEAT

BACKGROUND OF THE INVENTION

1. Field of the Invention

The present invention relates to toilet assemblies and more particularly pertains to a new automatic toilet seat for automatically lowering a toilet seat upon flushing of an associated toilet.

2. Description of the Prior Art

The use of toilet assemblies is known in the prior art. More specifically, toilet assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,369,814; U.S. Pat. No. 5,343,571; U.S. Pat. No. 5,604,936; U.S. Pat. No. 5,193,230; U.S. Pat. No. 3,404,411; and U.S. Pat. No. 2,117,663.

In these respects, the automatic toilet seat according to the present invention substantially departs from the conventional concepts and designs of the prior art, and in so doing provides an apparatus primarily developed for the purpose of automatically lowering a toilet seat upon flushing of an associated toilet.

SUMMARY OF THE INVENTION

In view of the foregoing disadvantages inherent in the known types of toilet assemblies now present in the prior art, the present invention provides a new automatic toilet seat construction wherein the same can be utilized for automatically lowering a toilet seat upon flushing of an associated toilet.

The general purpose of the present invention, which will be described subsequently in greater detail, is to provide a new automatic toilet seat apparatus and method which has many of the advantages of the toilet assemblies mentioned heretofore and many novel features that result in a new automatic toilet seat which is not anticipated, rendered obvious, suggested, or even implied by any of the prior art toilet assemblies, either alone or in any combination thereof.

To attain this, the present invention generally comprises a toilet having a bowl portion with an open top having an upper peripheral edge. Also included is a lid with a generally planar circular configuration and an annular seat with a generally planar O-shaped configuration. A rear tank portion extends upwardly from a rear of the bowl portion. Further, coupled to a bottom surface of the rear tank portion is a water intake line. In use, the toilet is adapted to accept water from the water intake line upon being flushed. FIGS. 8 & 9 show a first mounting assembly including a base having a bottom face coupled to the upper peripheral edge of the bowl portion of the toilet. An inner face of the base is equipped with a dowel extending therefrom for pivotally receiving an eyelet of an inboard end of an inner arm. Such inner arm has an outboard end fixedly coupled to the lid of the toilet. An outer face of the base has a substantially cylindrical shaped recess formed therein. The first mounting assembly further includes a hollow substantially cylindrical rotator rotatably mounted within the recess of the base and extending outwardly therefrom. The rotator has a radially extending flange with a threaded bore formed therein, as shown in FIG. 8. An outer arm of the first mounting assembly has an inboard end fixedly connected to the flange of the rotator and an outboard end connected to the seat of the toilet. A disk-shaped cap is rotatably mounted within the flange of the rotator and selectively fixed by way of a set screw. A coil spring has a first end connected to the base and a second end connected to the cap for urging the seat of the toilet into a lowered orientation. With reference now to FIGS. 3–7, a second mounting assembly is provided including a base having a bottom face coupled to the upper peripheral edge of the bowl portion of the toilet. An inner face of the base has an inner dowel extending therefrom for pivotally receiving an eyelet of an inboard end of an inner arm. The inner arm of the second mounting assembly has an outboard end fixedly coupled to the lid of the toilet. An outer face of the base of the second mounting assembly has an outer dowel extending therefrom for pivotally receiving an eyelet of an inboard end of an outer arm. Such outer arm has an outboard end fixedly coupled to the seat of the toilet. For reasons that will soon become apparent, the eyelet of the outer dowel has at least one recess formed therein. As shown in FIGS. 3 & 4, the outer face further includes a compartment having an O-ring mounted adjacent to an open end thereof. The second mounting assembly further includes a piston with an inboard end having a gasket mounted thereon for sliding within the compartment in a sealed manner. An outboard end of the piston is equipped with a hemispherical configuration which is slidably extended through the O-ring. Positioned about the piston is a coil spring that is coupled between the O-ring and the gasket. The coil spring is employed to return the piston to an initial position, and is especially effective for ensuring piston return in situations where low water pressure is encountered. When sufficient water pressure is present, the presence of the coil spring is not required since water pressure in the compartment will also act to return the piston to the initial position. Finally, a fluid splice is connected to the water intake line with a tube connected to a conduit formed in the second mounting assembly. As shown in FIGS. 5 & 6, the conduit resides in communication with the compartment for releasing fluidic pressure upon the toilet being flushed. The piston is thus urged out of engagement with the recess of the eyelet, thereby allowing the spring of the first mounting assembly to urge the seat into the lowered orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic toilet seat apparatus and method which has many of the advantages of the toilet assemblies mentioned heretofore and many novel features that result in a new automatic toilet seat which is not anticipated, rendered obvious, suggested, or even implied by any of the prior art toilet assemblies, either alone or in any combination thereof.

It is another object of the present invention to provide a new automatic toilet seat which may be easily and efficiently manufactured and marketed.

It is a further object of the present invention to provide a new automatic toilet seat which is of a durable and reliable construction.

An even further object of the present invention is to provide a new automatic toilet seat which is susceptible of a low cost of manufacture with regard to both materials and labor, and which accordingly is then susceptible of low prices of sale to the consuming public, thereby making such automatic toilet seat economically available to the buying public.

Still yet another object of the present invention is to provide a new automatic toilet seat which provides in the apparatuses and methods of the prior art some of the advantages thereof, while simultaneously overcoming some of the disadvantages normally associated therewith.

Still another object of the present invention is to provide a new automatic toilet seat for automatically lowering a toilet seat upon flushing of an associated toilet.

Even still another object of the present invention is to provide a new automatic toilet seat that includes a toilet having a bowl portion with an open top having an upper peripheral edge, an annular seat with a generally planar O-shaped configuration, a rear tank portion extending upwardly from a rear of the bowl portion, and a water intake line. In use, the toilet is adapted to accept water from the water intake line upon being flushed. Also included is at least one mounting assembly coupled to the bowl portion and pivotally coupled with respect to the seat of the toilet. The mounting assembly is in communication with either the rear tank portion or the water line of the toilet for effecting the lowering of the seat of the toilet upon the same being flushed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
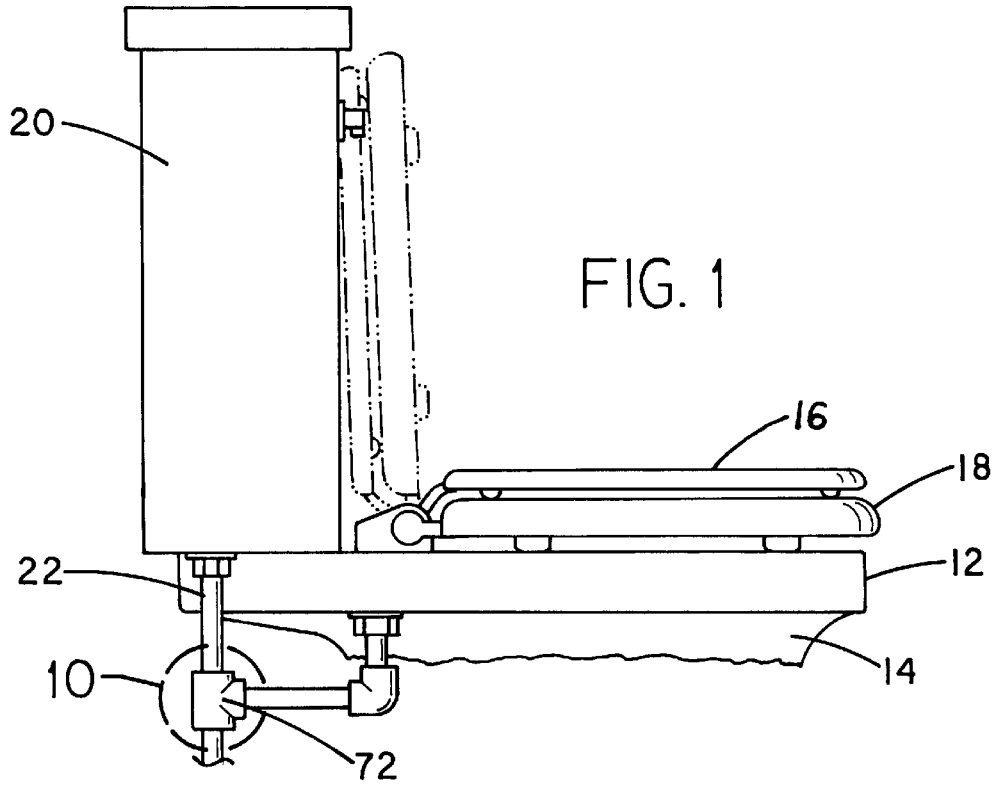
FIG. 1 is a side view of a new automatic toilet seat according to the present invention.
Figure 2:
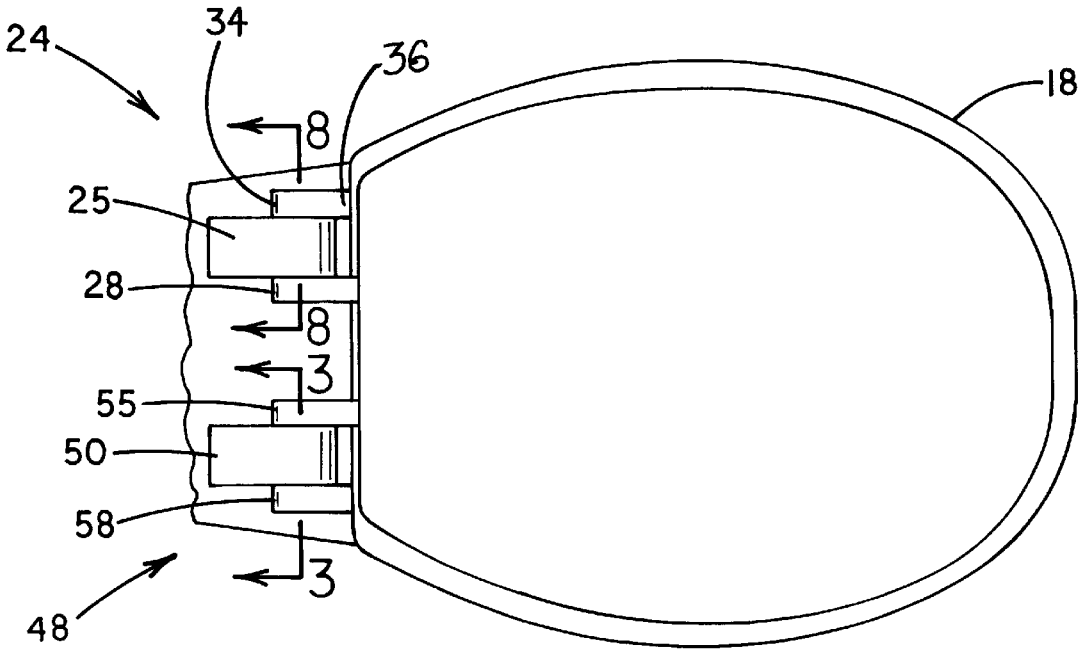
FIG. 2 is a top view of the present invention.

With reference now to the drawings, and in particular to FIGS. 1 through 10 thereof, a new automatic toilet seat embodying the principles and concepts of the present invention and generally designated by the reference numeral 10 will be described.

The present invention, designated as numeral 10, includes a toilet 12 having a bowl portion 14 with an open top having an upper peripheral edge. Also included is a lid 16 with a generally planar circular configuration and an annular seat 18 with a generally planar O-shaped configuration. A rear tank portion 20 extends upwardly from a rear of the bowl portion. Further, coupled to a bottom surface of the rear tank portion is a water intake line 22. In use, the toilet is adapted to accept water from the water intake line upon being flushed.

Figure 8:
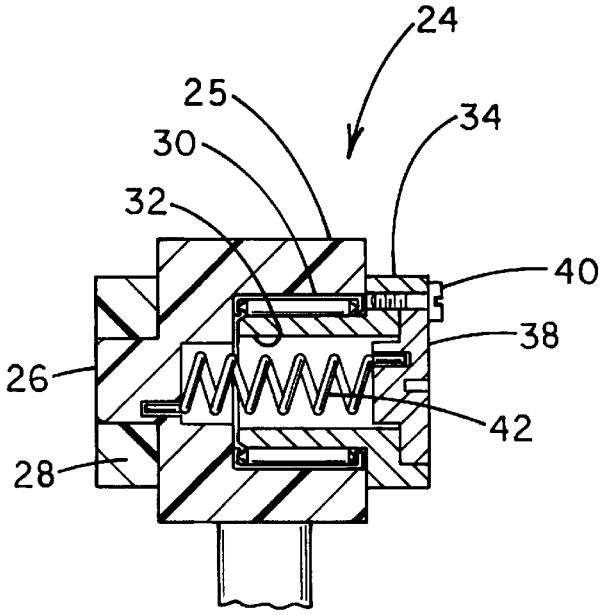
FIG. 8 is a cross-sectional view of the first mounting assembly of the present invention taken along line 8—8 shown in FIG. 2.
Figure 9:
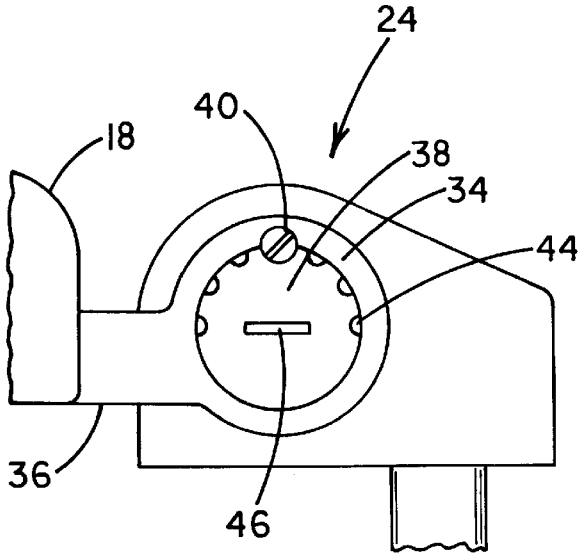
FIG. 9 is a side view of the second mounting assembly of the present invention.
Figure 10:
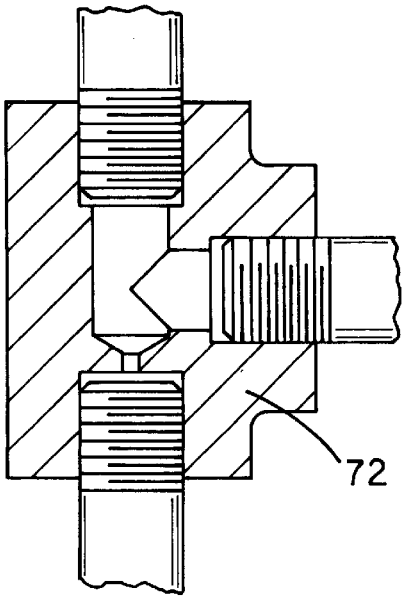
FIG. 10 is a cross-sectional view of the fluid splice mounting assembly of the present invention as shown in FIG. 1.

FIGS. 8 & 9 show a first mounting assembly 24 including a base 25 having a bottom face coupled to the upper peripheral edge of the bowl portion of the toilet. An inner face of the base is equipped with a dowel 26 extending therefrom for pivotally receiving an eyelet of an inboard end of an inner arm 28. Such inner arm has an outboard end fixedly coupled to the lid of the toilet. An outer face of the base has a substantially cylindrical shaped recess 30 formed therein.

The first mounting assembly further includes a hollow substantially cylindrical rotator 32 rotatably mounted within the recess of the base and extending outwardly therefrom. The rotator has a radially extending flange 34 with a threaded bore formed therein, as shown in FIG. 8. An outer arm 36 of the first mounting assembly has an inboard end fixedly connected to the flange of the rotator and an outboard end connected to the seat of the toilet. A disk-shaped cap 38 is rotatably mounted within the flange of the rotator and selectively fixed by way of a set screw 40. A flat or coil spring 42 has a first end connected to the base and a second end connected to the cap for urging the seat of the toilet into a lowered orientation. Ideally, the cap has a plurality of indents 44 for passing the set screw and securing the cap in the desired position. Note FIG. 9. Further, the cap preferably has a screwdriver receiving indent 46 to facilitate the rotation thereof. By this structure, aging of the spring may be rectified.

With reference now to FIGS. 3–7, a second mounting assembly 48 is provided including a base 50 having a bottom face coupled to the upper peripheral edge of the bowl portion of the toilet. An inner face of the base has an inner dowel 52 extending therefrom for pivotally receiving an eyelet 54 of an inboard end of an inner arm 55. The inner arm of the second mounting assembly has an outboard end fixedly coupled to the lid of the toilet. An outer face 56 of the base of the second mounting assembly has an outer dowel extending therefrom for pivotally receiving an eyelet of an inboard end of an outer arm 58. Such outer arm has an outboard end fixedly coupled to the seat of the toilet. For reasons that will soon become apparent, the eyelet of the outer dowel has at least one recess 60 formed therein.

Figure 3:
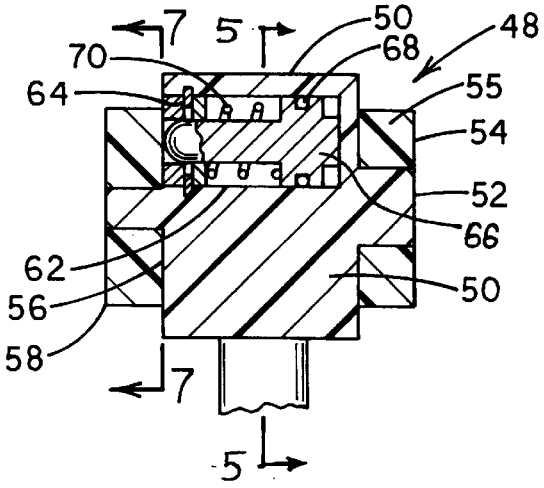
FIG. 3 is a cross-sectional view of the second mounting assembly of the present invention taken along line 3—3 shown in FIG. 2 when the seat is in a lowered orientation.
Figure 4:
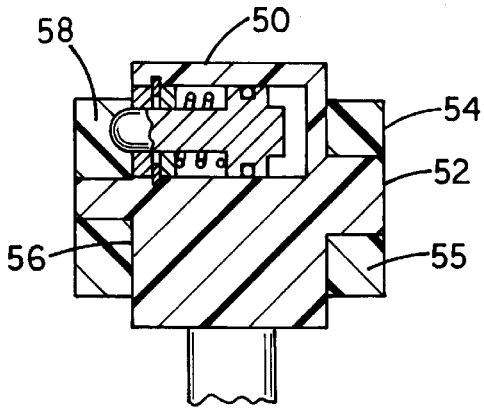
FIG. 4 is a cross-sectional view of the second mounting assembly of the present invention when the seat is in a raised orientation.

As shown in FIGS. 3 & 4, the outer face further includes a compartment 62 having an O-ring 64 mounted adjacent to an open end thereof. The second mounting assembly further includes a lock for maintaining the seat in a raised orientation until the deactivation of the lock. The lock comprises a piston 66 with an inboard end having a gasket 68 mounted thereon for sliding within the compartment in a sealed manner. An outboard end of the piston is equipped with a hemispherical configuration which is slidably extended through the O-ring. Positioned about the piston is a coil spring 70 that is coupled between the O-ring and the gasket. The coil spring 70 is employed to return the piston to an initial position, and is especially effective for ensuring piston return in situations where low water pressure is encountered. When sufficient water pressure is present, the presence of the coil spring 70 is not required since water pressure in the compartment will also act to return the piston to the initial position.

Figure 5:
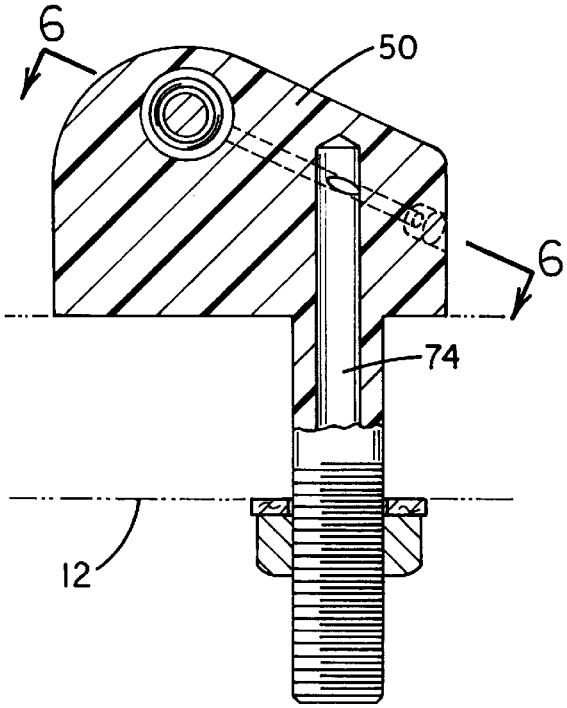
FIG. 5 is a cross-sectional view of the second mounting assembly of the present invention taken along line 5—5 shown in FIG. 3.
Figure 6:
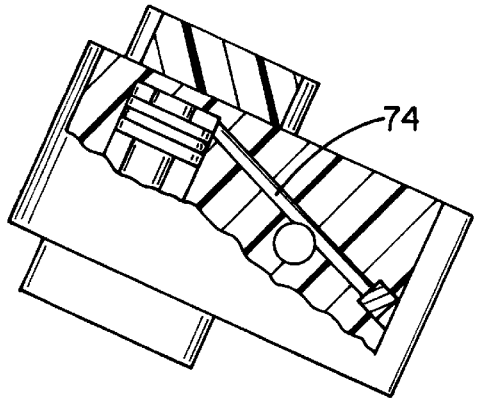
FIG. 6 is a cross-sectional view of the second mounting assembly of the present invention taken along line 6—6 shown in FIG. 5.
Figure 7:
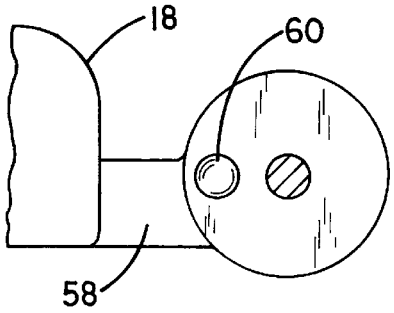
FIG. 7 is a cross-sectional view of the second mounting assembly of the present invention taken along line 7—7 shown in FIG. 3.

Finally, the lock also comprises a T-shaped fluid splice 72 is connected to the water intake line with a tube connected to a conduit 74 formed in the second mounting assembly. As shown in FIGS. 5 & 6, the conduit includes a vertical portion extending through an integral bolt mounted to the bottom face of the base of the second mounting assembly. Such vertical portion extends upwardly into communication with a horizontal portion. This horizontal portion of the conduit resides in communication with the compartment adjacent to an inboard end thereof for releasing fluidic pressure upon the toilet being flushed. The piston is thus urged out of engagement with the recess of the eyelet by the spring. This allows the spring of the first mounting assembly to urge the seat into the lowered orientation. It should be noted that the conduit may be directly connected to a bottom of the rear tank portion of the toilet in communication with the water therein and accomplish a similar objective. Further, it should be understood that the coil spring 70 is only used to ensure return of the piston when it is flushed and is mainly to ensure that the piston returns in low water pressure situations. In other words, the coil spring 70 is not necessarily required since water pressure in the compartment may be employed to return the same.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat automatic lowering system for a toilet including a bowl portion with an open top having an upper peripheral edge, a rear tank portion extending upwardly from a rear of the bowl portion, and a water intake line coupled to a bottom surface of the rear tank portion, wherein the toilet is adapted to accept water from the water intake line upon being flushed, the system comprising:

a lid with a generally planar circular configuration;

a generally annular seat;

a first mounting assembly including a base having a bottom face for coupling to the upper peripheral edge of the bowl portion of the toilet, the base having an inner face with a dowel extending therefrom for pivotally receiving an eyelet of an inboard end of an inner arm, the inner arm having an outboard end fixedly coupled to the lid, the base having an outer face with a recess formed therein, the first mounting assembly further including a substantially hollow rotator rotatably mounted in the recess of the base and extending outwardly therefrom with a radially extending flange having a threaded bore formed therein, an outer arm having an inboard end fixedly connected to the flange of the rotator and an outboard end connected to the seat of the toilet, a cap rotatably mounted in the flange of the rotator and selectively fixable by a set screw, and a spring having a first end connected to the base and a second end connected to the cap for urging the seat of the toilet into a lowered orientation;

a second mounting assembly including a base having a bottom face for coupling to the upper peripheral edge of the bowl portion of the toilet, the base having an inner face with an inner dowel extending therefrom for pivotally receiving an eyelet of an inboard end of an inner arm, the inner arm having an outboard end fixedly coupled to the lid, the base having an outer face with an outer dowel extending therefrom for pivotally receiving an eyelet of an inboard end of an outer arm, the outer arm having an outboard end fixedly coupled to the seat of the toilet, wherein the eyelet of the outer dowel has at least one recess formed therein, the outer face further including a compartment having an O-ring mounted adjacent to an open end of the compartment, the second mounting assembly further including a piston with an inboard end having a gasket mounted thereon for sliding in the compartment, the piston having an outboard end with a hemispherical configuration slidably extending through the O-ring, and a spring acting on the piston and coupled between the O-ring and the gasket for urging the outboard end of the piston into engagement with the recess of the eyelet, thereby maintaining the lid and seat of the toilet in a raised orientation against the force of the spring of the first mounting assembly; and a fluid splice connected to the water intake line with a tube connected to a conduit formed in the second mounting assembly, the conduit being in fluid communication with the compartment for releasing fluidic pressure upon the toilet being flushed for urging the piston out of engagement with the recess of the eyelet, thereby allowing the spring of the first mounting assembly to urge the seat into the lowered orientation.

2. A toilet seat automatic lowering system comprising, in combination:

a toilet including a bowl portion with an open top having an upper peripheral edge, a lid with a generally planar circular configuration, an annular seat with a generally planar O-shaped configuration, a rear tank portion extending upwardly from a rear of the bowl portion, and a water intake line coupled to a bottom surface of the rear tank portion, wherein the toilet is adapted to accept water from the water intake line upon being flushed;

a first mounting assembly including a base having a bottom face coupled to the upper peripheral edge of the bowl portion of the toilet, an inner face with a dowel extending therefrom for pivotally receiving an eyelet of an inboard end of an inner arm having an outboard end fixedly coupled to the lid of the toilet, and an outer face having a substantially cylindrical shaped recess formed therein, the first mounting assembly further including a hollow substantially cylindrical rotator rotatably mounted within the recess of the base and extending outwardly therefrom with a radially extending flange having a threaded bore formed therein, an outer arm having an inboard end fixedly connected to the flange of the rotator and an outboard end connected to the seat of the toilet, a disk-shaped cap rotatably mounted within the flange of the rotator and selectively fixed by way of a set screw, and a coil spring having a first end connected to the base and a second end connected to the cap for urging the seat of the toilet into a lowered orientation;

a second mounting assembly including a base having a bottom face coupled to the upper peripheral edge of the bowl portion of the toilet, an inner face with an inner dowel extending therefrom for pivotally receiving an eyelet of an inboard end of an inner arm having an outboard end fixedly coupled to the lid of the toilet, and an outer face with an outer dowel extending therefrom for pivotally receiving an eyelet of an inboard end of an outer arm having an outboard end fixedly coupled to the seat of the toilet, wherein the eyelet of the outer dowel has at least one recess formed therein, the outer face further including a compartment having an O-ring mounted adjacent to an open end thereof, the second mounting assembly further including a piston with an inboard end having a gasket mounted thereon for sliding within the compartment in a sealed manner and an outboard end with a hemispherical configuration slidably extending through the O-ring, and a coil spring positioned about the piston and coupled between the O-ring and the gasket for urging the outboard end into engagement with the recess of the eyelet, thereby maintaining the lid and seat of the toilet in a raised orientation against the force of the spring of the first mounting assembly; and a fluid splice connected to the water intake line with a tube connected to a conduit formed in the second mounting assembly which resides in communication with the compartment for releasing fluidic pressure upon the toilet being flushed thus urging the piston out of engagement with the recess of the eyelet, thereby allowing the spring of the first mounting assembly to urge the seat into the lowered orientation.

* * * * *